US012071757B2

(12) United States Patent
Hancock

(10) Patent No.: US 12,071,757 B2
(45) Date of Patent: Aug. 27, 2024

(54) TOILET FIXTURE

(71) Applicant: Maurice Hancock, Downs, KS (US)

(72) Inventor: Maurice Hancock, Downs, KS (US)

( * ) Notice: Subject to any disclaimer, the term of this patent is extended or adjusted under 35 U.S.C. 154(b) by 238 days.

(21) Appl. No.: 17/877,213

(22) Filed: Jul. 29, 2022

(65) Prior Publication Data

US 2022/0364345 A1 Nov. 17, 2022

(51) Int. Cl.
*E03D 5/02* (2006.01)
*E03D 5/012* (2006.01)

(52) U.S. Cl.
CPC ..... *E03D 5/024* (2013.01); *E03D 5/012* (2013.01)

(58) Field of Classification Search
CPC ..... E03D 5/024; E03D 5/012; E03D 9/00; E03D 11/00; E03D 11/13
USPC ..... 4/420, 421–424, 300.3, 407, 427, 428, 4/696, 219
See application file for complete search history.

(56) References Cited

U.S. PATENT DOCUMENTS 1,180,171 A * 4/1916 Middleton ..... E03D 11/00 4/427
2,778,029 A * 1/1957 Young ..... E03D 11/13 4/427
2015/0299998 A1* 10/2015 Stack ..... E03D 11/13 4/427
2015/0322660 A1* 11/2015 Conrad ..... E03D 11/13 4/427

* cited by examiner

*Primary Examiner* — Tuan N Nguyen
(74) *Attorney, Agent, or Firm* — Low Office of Julie Scott LLC

(57) ABSTRACT

The present invention provides an improvement for toilet fixtures that reduces the amount of wastewater that splashes out of a toilet during its use. This reduction in splashing reduces the odor and unsanitary conditions that frequently occur on and around a toilet. Advantageously, the invention allows a user to temporarily change an existing fixture to function similarly to a urinal and then return the fixture to its function as a toilet for both liquid and solid waste removal.

19 Claims, 3 Drawing Sheets

TOILET FIXTURE

BACKGROUND OF THE INVENTION

A. Field of the Invention

The present invention relates to toilets that can be temporarily altered to function as urinals, as well as, associated systems, kits, and methods.

B. Description of the Related Art

A common problem in bathrooms is the splashing from upright urination that occurs around a toilet. This splashing results in undesirable odors and unsanitary conditions on and around toilets.

Various attempts have been made to reduce this splashing. For example, U.S. Pat. Nos. 3,193,845, 4,060,859, 4,133,062, and 9,809,964 describe a variety of retractable or pleated shields that can be secured to a toilet. None of these shields provide a complete solution to the problem and can be unattractive. Alternatively, U.S. Pat. Nos. 5,276,925, 6,305,034, and 7,496,974 describe retractable or flexible urinals that can be attached to standard toilets. These attachable urinals do not fully address the problem of splashing in or around a toilet and require additional space that is often not available.

SUMMARY OF THE INVENTION

The present invention provides a modification to a toilet that allows a user to temporarily alter the toilet to function as a urinal and then return the fixture to its intended function as a toilet. The invention is particularly suitable for use with siphonic toilets, which are popular in the United States. Advantageously, compositions, systems, methods, and kits of the invention can be applied to either existing toilets or the manufacturing of new fixtures.

The invention allows a user to temporarily reduce the water level in a toilet bowl so that there is less water to be displaced by the impact of liquid waste and splash out of the bowl. Once a user has finished using the toilet, the invention can be easily disengaged so that the toilet flushes the waste and wastewater as originally designed, the toilet bowl is refilled with water to the original level, and the toilet is ready for use.

While in most cases it is expected that a fixture will be returned to its intended ready state as a toilet by the user using the flushing mechanism that is installed on the fixture, it will be appreciated that an alternative flushing mechanism can be incorporated into systems and devices of the invention to accommodate users' preferences or needs for an alternative flushing option.

In particular the present invention provides a toilet comprising (a) a bowl; (b) a trapway having an upper lateral opening and a lower lateral opening, wherein the upper lateral opening is attached to a near end of a first water supply line, and the lower lateral opening is attached to a near end of a second water supply line; (c) a valve that is attached at its first end to a far end of the first water supply line and at its second end to a far end of the second water supply line; (d) a valve actuator that is attached to the valve; (e) a seal that is attached at its near end to the valve actuator and at its far end extends inside the valve between the first water supply line and the second water supply line; and (f) an actuator.

The upper lateral opening is attached to the first (or upper) water supply line by a first connector, and the lower lateral opening is attached to the second (or lower) water supply line by a second connector. Those of skill in the art will appreciate that a variety of connectors exist and may be used in the invention. Suitable connectors may be made from plastics, polyvinylchloride (pvc), rubbers, metals, or a combination thereof and include, for example, coupling and adapter fittings, bushing fittings, union fittings, threaded fittings, or other known plumbing fittings. Alternatively, a connector may be malleable such as plumber's putty or caulking, or a connector may be a combination of a suitable plumbing fitting and a malleable material. It is only necessary that a connector can attach a lateral opening in the trapway to a water supply line with a watertight seal.

A preferred valve actuator is a pneumatic valve actuator that includes a spring, a flexible diaphragm, a connecting rod (or arm), and a protrusion or other means of attaching the valve actuator to an actuator. A variety of pneumatic valve actuators are known in the arts and can be incorporated into the invention. Preferably, a pneumatic valve actuator is attached at its protrusion to a first end of an air hose that is attached at its second end to an actuator.

Alternatively, a valve actuator may be incorporated into a valve such as a control valve. For example, the valve may be a ball valve or a gate valve. It is only necessary that the chosen valve allows water to flow from the first water supply line to the second water supply line when the invention is activated and prevents water from flowing from the first water supply line to the second water supply line when the invention is inactivated.

A preferred, suitable seal has a means of attaching the seal to the valve actuator at its near end, and a broad, flat or paddle-like far end that extends into the valve and acts to block the passage of water from the upper water supply line through the valve and into the lower water supply line. Skilled artisans will appreciate that suitable seals can be configured in a variety of alternative ways and achieve the same functionality.

Preferred actuators are low pressure pneumatic actuators. A variety of low pressure actuators are known in the art. Suitable pneumatic actuators for use in the invention can generate 1 to 30 psig of air pressure. More preferably, suitable actuators generate 1 to 15 psig, and most preferably, a suitable low pressure actuator generates 5 to 10 psig of air pressure when it is activated. Those of skill in the art will appreciate that pneumatic actuators capable of producing greater amounts of air pressure may be used in the invention.

One preferred type of actuator is a foot pedal. The skilled artisan will appreciate that other types of actuators are suitable for use in the invention. An actuator may be a handle, wheel, push button, an electronic remote control, or a combination thereof. It is only necessary that the selected actuator can activate the invention when desired. For example, it may be desirable for some users to use a foot pedal to activate the invention, and other users may prefer to use a remote control to activate the invention. Those of skill in the art will appreciate that a variety of suitable electronic remote controls, wired or wireless, exist. Advantageously, some remote controls can be programmed to flush the fixture after a specified period of time has lapsed or when motion is no longer detected, so that a user does not need to do so manually. Alternatively, a remote control can be programmed to prevent an undesired activation of the invention such as by a pet or child. Those of skill in the art will recognize that the valve actuator and actuator can be combined into a single unit, and such combinations do not necessarily require an air tube.

Skilled artisans will recognize that seals that are suitable for use in the invention can have a variety of configurations. It is only necessary that the seal can block the passage of water from the upper water supply line through the valve into the lower water supply line. Preferred seals include a flattened blade or paddle at its far end that extends into the valve and can block the passage of water between the two water supply lines. Preferred seals attach to the connecting arm (or rod) of the valve actuator in such a way that when the connecting arm is extended from the valve actuator by the activation of the invention, the far end of the seal is moved so that water can pass through the valve. When the invention is inactivated, the seal returns to its original position.

The invention also provides methods of modifying a toilet. Such methods comprise the steps of (a) making an upper lateral opening and a lower lateral opening in a trapway of a toilet; (b) connecting the upper lateral opening to a near end of a first water supply line and the lower lateral opening to a near end of a second water supply line; (c) connecting the far end of the first water supply line and the far end of the second water supply line to a valve; (d) connecting the valve to a valve actuator; (e) attaching the valve actuator to a near end of a seal that extends at its far end into the valve between the first water supply line and the second water supply line; and (f) connecting the valve actuator to an actuator.

In some methods of modifying a toilet a first connector attaches the upper lateral opening to the near end of the first water supply line and a second connector attaches the lower lateral opening to the near end of the second water supply line. Those of skill in the art will appreciated that a variety of suitable connectors are available and known in the art. It is only necessary that the connector attaches the water supply line to a lateral opening in the trapway such that a watertight seal is created.

The invention also provides kits to modify existing toilets. Kits of the invention comprise (a) a first water supply line and a second water supply line; (b) a first connector and a second connector; (c) a valve; (d) a valve actuator; (e) a restraint; (f) a seal; (g) an air hose; (h) an actuator; and (i) instructions to modify a toilet. Preferred kits of the invention include a low pressure pneumatic actuator. A preferred actuator to include in a kit is a foot pedal. Those of skill in the art will appreciate that kits that include a combined valve and valve actuator do not necessarily include a restraint that is intended to join a valve and valve actuator to each other. Further, kits that include an actuator that is not a pneumatic actuator do not necessarily include an air hose.

The invention also includes methods of manufacturing a modified toilet that includes an embodiment of the invention. Such modified toilets include a trapway that is modified to include upper and lower lateral openings. These modified toilets can further include passageways as part of their structure that act as the water supply lines so that separate water supply lines and connectors are not necessary.

Other objects, features and advantages of the present invention will become apparent from the following detailed description. It should be understood, however, that the detailed description and the specific examples, while indicating preferred embodiments of the invention, are given by way of illustration only, since various changes and modifications within the spirit and scope of the invention will become apparent to those skilled in the art from this detailed description. Further, while specific advantages of the invention are detailed herein, various embodiments may include some, none, or all of these enumerated advantages.

BRIEF DESCRIPTION OF THE DRAWINGS

The following drawings form part of the present specification and are included to further demonstrate certain aspects of the present invention. The invention may be better understood by reference to one or more of these drawings in combination with the detailed description presented herein. Unless specifically noted, articles depicted in the drawings are not necessarily drawn to scale.

DETAILED DESCRIPTION

Figure 1:
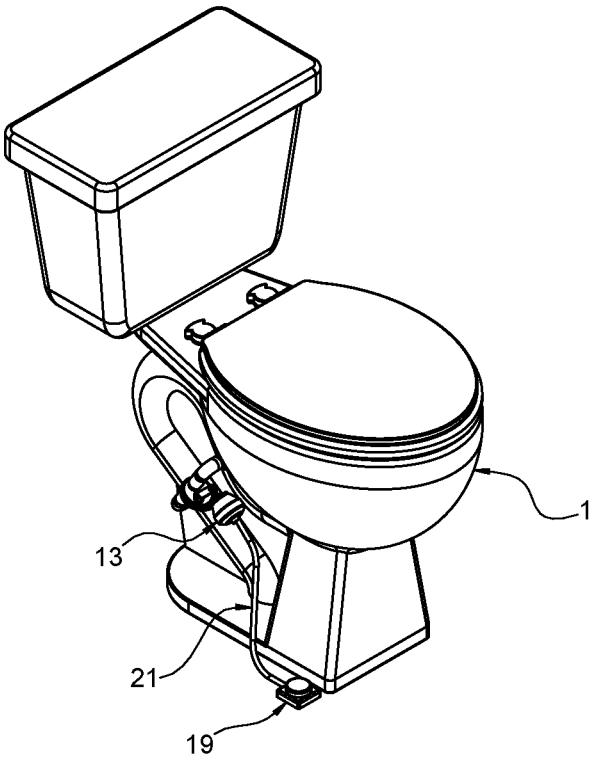
FIG. 1 is a front isometric exterior view a toilet that has been modified to include the invention.

The invention provides a modification for a toilet fixture that temporarily switches the fixture to function as a urinal and then returns the fixture to function as a toilet. The invention is particularly suitable for fixtures that have a reverse 'P' or 'S' shape trapway (aka siphonic toilets) where the upper end of the trapway is the outlet from the toilet bowl, the lower end of the trapway is connected to the drainpipe. Those of skill in the art will appreciate that the invention also can work with toilet fixtures that have a differently shaped trapway. It is only necessary that between the two ends of the trapway there is a sharp bend or weir in the trapway over which water flows when the fixture is in use.

When a user activates a siphonic toilet to flush, a flush valve opens to let the tank water flow from the tank into the bowl. Because the water typically flows out from the tank faster than it exits from the bowl, the water in the bowl initially rises and then subsides rapidly as it exits the bowl through the trapway. As water exits through the trapway into a drainpipe, the water displaces the air inside the trapway to create a vacuum. When the water flows over the bend (or weir) in the trapway, a siphon is created. At its optimum state, the siphon is so strong that heavy solid wastes are sucked out of the bowl with the water. Towards the end of the flush the vacuum is broken, and the siphon ends. The bowl is filled with remnant water from the tank, and the tank refills. The addition of water to the tank forces air to the top of the tank and down a transfer tube into the trapway. The air forced into the trapway pressurizes the trapway and exerts positive pressure on the water in the bowl so that water is retained in the bowl. The toilet is returned to its ready state.

Pressurizing the trapway and exerting positive pressure on the water in the bowl results in a relatively large, exposed water surface area in the bowl and a relatively small, exposed surface area of the bowl that waste can impact. The large water surface area contributes to the splashing associated with upright urination on and around the toilet, because the water is displaced by the kinetic force of liquid waste impacting the water. This kinetic force is large enough that small amounts of liquid waste and wastewater splash out of the bowl onto nearby surfaces to cause undesirable odors and unsanitary conditions on and around a toilet.

The present invention reduces the water surface area in the bowl and increases the exposed surface area of the bowl, so that a user can better avoid contacting the water in the bowl and transferring kinetic force to the water to cause a splash. In addition, the exposed surface of the bowl functions like the surface of a urinal so that the potential for splashing is reduced. After use, the present invention allows the flush cycle to be completed and return to the fixture to its ready state as a toilet. It is expected that in most cases the fixture is returned to its ready state by the user flushing the toilet. Alternatively, a sensor can be attached to the fixture to detect the change in the water level in the tank, or a timer or motion detector can be attached to the fixture or invention to trigger a flush and reset the fixture to its ready state as a toilet. Versions of the invention that include such sensors may be preferred by users unable to stand or lacking good balance or by users that tend to not remember to flush the fixture after use.

Figure 2:
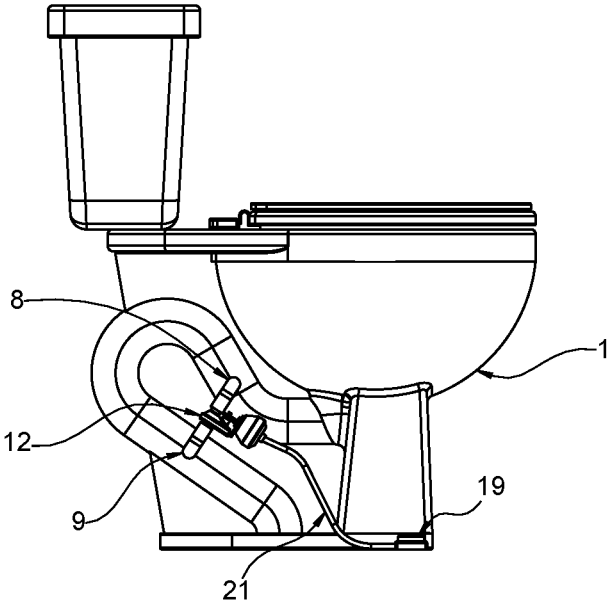
FIG. 2 is a lateral exterior view of a toilet that has been modified to include the invention.
Figure 5:
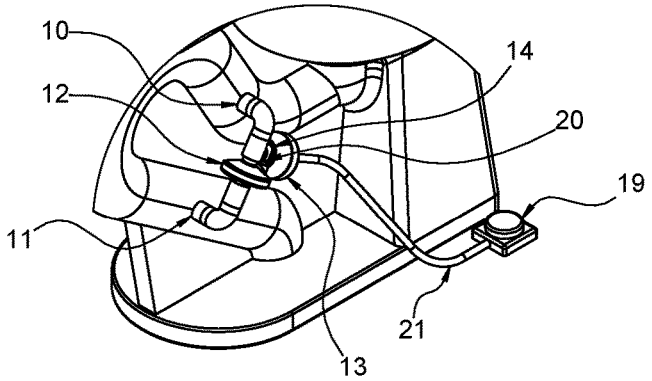
FIG. 5 shows a perspective exterior close up view of the water lines, valve, valve actuator, seal, and actuator installed on a toilet.

Specifically, the invention provides a toilet 1 comprising a bowl 2 and a trapway 3 that is connected to a drainpipe. The trapway 3 has two lateral openings in it. An upper lateral opening 4 is located below the normal waterline 6 of a toilet 1 in its ready state and before a bend (or weir) in the trapway 3 over which water flows to create a siphon. The lower lateral opening 5 is located past the bend (or weir) in the trapway 3. The upper lateral opening 4 attaches to the near end of a first (or upper) water supply line 8; and the lower lateral opening 5 attaches to a near end of a second (or lower) water supply line 9. Preferably, the upper lateral opening 4 is attached to the near end of the first water supply line 8 by a first connector 10, and the lower lateral opening 5 is attached to the near end of the second supply line 9 by a second connector 11. See FIGS. 1, 2, and 5. Those of skill in the art will appreciate that a variety of suitable connectors are available and may be used in the invention. For example, a connector may comprise both a male and a female part. Alternatively, a threaded connector may be attached to a correspondingly threaded lateral opening.

The far end of the first water supply line 8 is attached to a first connecting end of the valve 12, and the far end of the second water supply line 9 is attached to a second connecting end of the valve 12. While a variety of valves may be suitable for use in the invention, a preferred type of valve is a linear valve. Depending upon a specific valve's construction and configuration, a second set of connectors may be used to attach the water supply lines to the valve.

Figure 7:
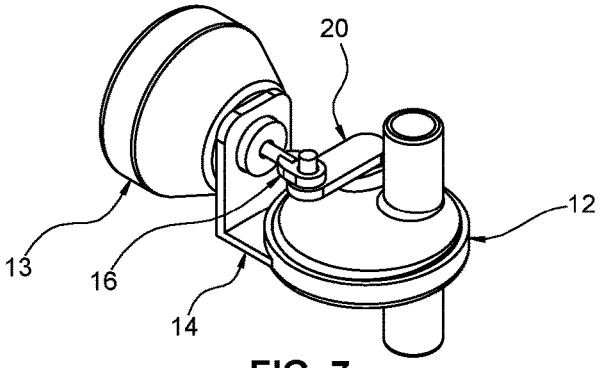
FIG. 7 shows a close exterior side perspective view of a valve attached to a valve actuator by the seal.
Figure 8:
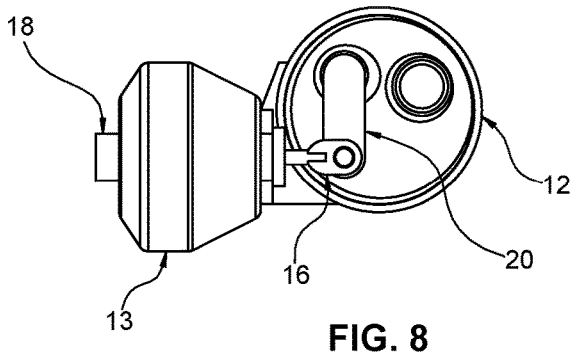
FIG. 8 shows a valve attached to a valve actuator by the seal from a different view as compared to FIG. 7.

The valve 12, in turn, is attached to a valve actuator 13. In an exemplary embodiment, the valve 12 is attached to the valve actuator 13 by a restraint 14. See FIGS. 5, 7, and 8. A variety of valve actuators are known in the art and are suitable for use in the invention. Further, those of skill in the art will appreciate that a variety of restraints may be suitable for attaching the valve to the valve actuator. In some embodiments, a single part may be manufactured that acts as both a valve and a valve actuator. In such embodiments, a separate restraint may not be necessary.

Figure 6:
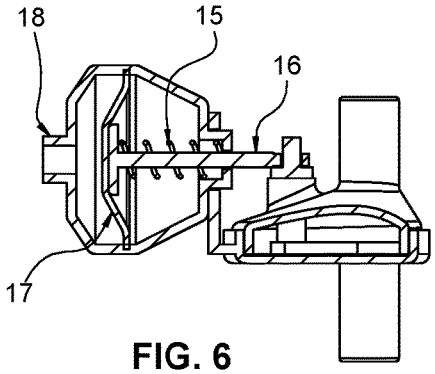
FIG. 6 is a diagram of the interior of an exemplary pneumatic valve actuator.

A preferred valve actuator is a pneumatic valve actuator that includes a diaphragm 17, a spring 15, a protrusion 18, and a connecting rod 16. FIG. 6 illustrates the interior of a pneumatic valve actuator and shows the positions of the connecting rod 16, the diaphragm 17, and the spring 15 relative to each other and to the protrusion 18. The protrusion 18 is attached to a first end of an air hose 21 (aka, an actuator tube or valve actuator tube). A second end of the air hose 21 is attached to an actuator 19.

A preferred actuator is a low pressure actuator that when operated can generate 1 to 15 psig of air pressure. A particularly preferred actuator is a foot pedal. See FIGS. 1, 2, and 5. Other types of actuators are known in the arts and are suitable for use in the invention. For example, an actuator may be electronic, manual, or hydraulic. The specific selection of an actuator will depend, at least in part, upon the user's preferences, physical abilities, and the configuration of the space around the toilet.

Figure 3:
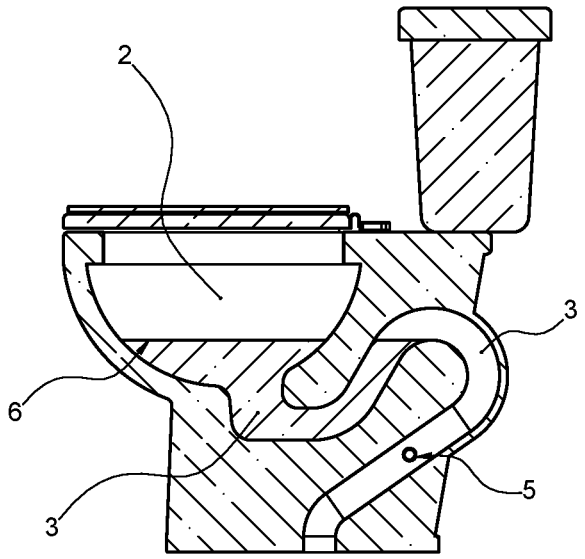
FIG. 3 is a lateral view of a cross-section of a toilet with the modification for a urinal in the inactive state.

In a preferred embodiment of the valve actuator, the connecting rod 16 extends outside of the valve actuator 13 and is attached to a near end (or stem) of a seal 20 such that the seal 20 can move or rotate when the connecting rod 16 is moved. The far end of the seal 20 (or flat end or paddle) extends into the valve 12 to separate the upper water supply line 8 from the lower water supply line 9. When the invention is in its inactive state, the paddle end of the seal 20 prevents water from flowing from the upper water supply line 8 through the valve 12 into the lower water supply line 9. See FIG. 3.

Figure 4:
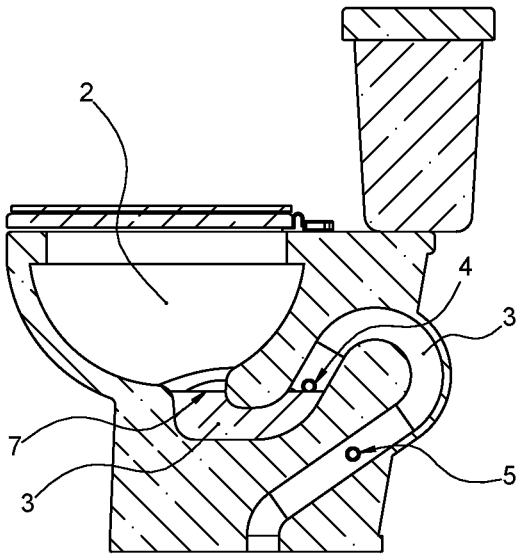
FIG. 4 shows a lateral view of a cross-section of a toilet with the modification for a urinal in the active state.

The invention is activated by a user operating the actuator 19. In a preferred embodiment, when the invention is activated, air pressure is increased inside the valve actuator 13; the diaphragm 17 is distended such that the spring 15 is compressed, and the connecting rod 16 is extended further outside of the valve actuator 13. When the connecting rod 16 is extended further, the seal 20 is pulled back and its far end no longer blocks the flow of water. Water drains from the bowl 2 through the valve 12 from the first water supply line 8 into the second water supply line 9 to lower the water level in the bowl 2. As a result, there is less water surface available in the bowl 2, the exposed surface area of the bowl is increased, and a user can better avoid transferring kinetic force to the remaining water to cause a splash. See FIG. 4.

After use, the user deactivates the invention by no longer operating the actuator 19 (i.e. the user steps off of the foot pedal or otherwise disengages the actuator). In the exemplary embodiment, removing the pressure on the foot pedal (i.e. the actuator 19) reduces the air pressure inside the valve actuator 13 so that the spring 15 is no longer compressed, the diaphragm 17 is no longer distended, and the connecting rod 16 is no longer extended. When the connecting rod 16 is no longer extended, the seal 20 returns to its original position within the valve 12.

To refill the fixture and return it to its ready state as a toilet, it is expected that in most cases the user flushes the toilet using the toilet's handle or other normal operating device. Alternatively, the toilet may include a sensor that detects the low water level in the bowl or tank and triggers the toilet to refill automatically.

Unless defined otherwise, all technical and scientific terms used herein have the same meaning as is commonly understood by one of skill in the art to which this invention belongs at the time of filing. Terminology used herein is for the purpose of describing particular embodiments of the invention and is not intended to be limiting. The meaning and scope of terms should be clear; however, in the event of any latent ambiguity, definitions provided herein take precedent over any dictionary or extrinsic definition. Further, unless otherwise required by context, singular terms shall include pluralities and plural terms shall include the singular unless the content clearly dictates otherwise. Herein, the use of "or" means "and/or" unless stated otherwise. Furthermore, the use of the term "including", as well as other forms such as "includes" and "included" is not limiting. As used herein, "each" refers to each member of a set or each member of a subset of a set. All patents and publications referred to herein are incorporated by reference herein.

It should be appreciated by those of skill in the art that the techniques disclosed in the following examples represent techniques discovered by the inventors to function well in the practice of the invention, and thus can be considered to constitute preferred modes of practice. However, those of skill in the art should, in light of the present disclosure, appreciate that many changes can be made in the specific embodiments which are disclosed and still obtain a like or similar result without departing from the spirit and scope of the invention. Thus, the present invention should not be limited to the exemplary embodiments and techniques illustrated herein.

What is claimed is:

1. A toilet comprising a) a bowl;

b) a trapway having an upper lateral opening and a lower lateral opening, wherein the upper lateral opening is attached to a near end of a first water supply line and the lower lateral opening is attached to a near end of a second water supply line;

c) a valve that is attached to a far end of the first water supply line and a far end of the second water supply line;

d) a valve actuator that is attached to the valve;

e) a seal that is attached to the valve actuator and extends inside the valve between the first water supply line and the second water supply line; and f) an actuator.

2. The toilet of claim 1, wherein the upper lateral opening is attached to the first water supply line by a first connector, and the lower lateral opening is attached to the second water supply line by a second connector.

3. The toilet of claim 1, wherein the valve actuator is a pneumatic valve actuator that includes a spring, a diaphragm, and a connecting rod.

4. The toilet of claim 1, wherein the actuator is a foot pedal.

5. The toilet of claim 1, wherein the actuator is a pneumatic actuator that is attached to a first end of an air hose, and the valve actuator is a pneumatic valve actuator that is attached to a second end of the air hose.

6. The toilet of claim 5, wherein the pneumatic actuator generates 1 to 15 psig of air pressure.

7. The toilet of claim 1, wherein the valve is a control valve that includes the valve actuator.

8. The toilet of claim 7, wherein the control valve is a ball valve or a gate valve.

9. A method of modifying a toilet comprising a) making an upper lateral opening and a lower lateral opening in a trapway of a toilet;

b) connecting the upper lateral opening to a near end of a first water supply line and the lower lateral opening to a near end of a second water supply line;

c) connecting the far end of the first water supply line and the far end of the second water supply line to a valve;

d) connecting the valve to a valve actuator;

e) attaching the valve actuator to a near end of a seal that extends at its far end into the valve between the first water supply line and the second water supply line; and f) connecting the valve actuator to an actuator.

10. The method of modifying a toilet of claim 9, wherein a first connector attaches the upper lateral opening to the near end of the first water supply line and a second connector attaches the lower lateral opening to the near end of the second water supply line.

11. The method of modifying a toilet of claim 9, wherein the valve actuator is a pneumatic valve actuator that includes a spring, a diaphragm, and a connecting rod that extends outside of the valve actuator and is attached to the near end of the seal.

12. The method of modifying a toilet of claim 9, wherein the actuator is a pneumatic actuator that is connected to a first end of an air hose, and the valve actuator is a pneumatic valve actuator that is connected to a second end of the air hose.

13. The method of modifying a toilet of claim 12, wherein the pneumatic actuator is a low pressure actuator that generates 1 to 15 psig, of air pressure.

14. The method of modifying a toilet of claim 9, wherein the valve is a control valve that includes the actuator and is a ball valve or a gate valve.

15. A kit to modify a toilet comprising a) a first water supply line and a second water supply line;

b) a first connector and a second connector;

c) a valve;

d) a valve actuator;

e) a restraint;

f) a seal;

g) an air hose;

h) an actuator; and i) instructions to modify a toilet.

16. The kit of claim 15, wherein the valve actuator is a pneumatic valve actuator that includes a spring, a diaphragm, a connecting rod that attaches to the seal, and a protrusion that attaches to a first end of the air hose.

17. The kit of claim 15, wherein the actuator is a pneumatic actuator that generates 1 to 15 psig of air pressure and attaches to a second end of the air hose.

18. The kit of claim 15, wherein the valve is a ball valve or a gate valve.

19. The kit of claim 15, wherein the restraint attaches the valve to the valve actuator.

* * * * *